US006935975B2

(12) United States Patent
Chang et al.

(10) Patent No.: US 6,935,975 B2
(45) Date of Patent: Aug. 30, 2005

(54) RACQUET WITH CHANNELED HANDLE FOR RECEIVING RACQUET STRING

(75) Inventors: Chin-Chi Chang, Taichung (TW); Po-Jen Cheng, Oak Brook, IL (US)

(73) Assignees: Wilson Sporting Goods Co., Chicago, IL (US); Li Mao Sports Co., Inc. (TW)

( * ) Notice: Subject to any disclaimer, the term of this patent is extended or adjusted under 35 U.S.C. 154(b) by 0 days.

(21) Appl. No.: 10/410,818

(22) Filed: Apr. 10, 2003

(65) Prior Publication Data

US 2004/0204270 A1 Oct. 14, 2004

(51) Int. Cl.[7] ..... A63B 49/08; A63B 49/02

(52) U.S. Cl. ..... 473/549; 473/523; 473/540; 473/542; 473/543

(58) Field of Search ..... 473/520–524, 473/534, 540, 542, 543, 549, 551

(56) References Cited

U.S. PATENT DOCUMENTS

| | | | | | |
|---|---|---|---|---|---|
| 346,858 | A | * | 8/1886 | Moss | 473/551 |
| 2,089,118 | A | * | 8/1937 | Fritsch | 473/534 |
| 2,280,382 | A | * | 4/1942 | Davis | 473/549 |
| 3,884,467 | A | | 5/1975 | Sommer | |
| 4,026,553 | A | * | 5/1977 | Vendramini | 473/534 |
| 4,333,650 | A | | 6/1982 | Soong | |
| 4,437,662 | A | | 3/1984 | Soong | |
| 4,595,201 | A | * | 6/1986 | Fischer | 473/534 |
| 4,613,138 | A | * | 9/1986 | Haythornthwaite | 473/534 |
| 4,765,621 | A | * | 8/1988 | Game | 473/534 |
| 5,034,082 | A | * | 7/1991 | Nolan | 156/245 |
| 5,088,734 | A | * | 2/1992 | Glava | 473/523 |
| 5,137,273 | A | | 8/1992 | Jseng | |
| 5,240,247 | A | * | 8/1993 | Didier | 473/523 |
| 5,242,724 | A | * | 9/1993 | You | 473/521 |
| 5,269,516 | A | * | 12/1993 | Janes | 473/523 |
| 5,464,210 | A | | 11/1995 | Davis et al. | |
| 5,779,571 | A | | 7/1998 | Roggenkamp | |
| 5,860,878 | A | | 1/1999 | You | |
| 5,919,104 | A | | 7/1999 | Mortvedt et al. | |
| 6,050,909 | A | | 4/2000 | Severa et al. | |
| 6,062,994 | A | | 5/2000 | Grimes et al. | |
| 6,432,005 | B1 | | 8/2002 | Lin | |
| 2003/0100389 | A1 | * | 5/2003 | Severa et al. | 473/549 |

FOREIGN PATENT DOCUMENTS

| | | | | |
|---|---|---|---|---|
| DE | 2857022 | * | 5/1980 | 473/FOR 173 |
| DE | 3341256 | * | 5/1985 | 473/FOR 183 |
| EP | 0 201 953 A1 | | 11/1986 | |
| EP | 0 727 244 A1 | | 8/1996 | |
| GB | 170717 | * | 11/1921 | 473/FOR 183 |

* cited by examiner

*Primary Examiner*—Raleigh W. Chiu
(74) *Attorney, Agent, or Firm*—Terence P. O'Brien

(57) ABSTRACT

A sports racquet extending along a longitudinal axis. The racquet includes a head portion and a handle portion. The head portion defines a string bed area. The handle portion has a distal end and a proximal end. The distal end of the handle portion is coupled to the head portion. The handle portion has a length and an outer surface. The handle portion includes at least two spaced apart channels. Each channel inwardly extends into the outer surface and extends generally parallel to the longitudinal axis from the distal end of the handle portion and over at least a portion of the length of the handle portion. Each channel is configured for receiving at least one string and for guiding the string along at least a portion of the length of the handle portion.

28 Claims, 12 Drawing Sheets

RACQUET WITH CHANNELED HANDLE FOR RECEIVING RACQUET STRING

FIELD OF THE INVENTION

The present invention relates generally to a sports racquet. In particular, the present invention relates to racquet including a handle portion with at least two channels for receiving racquet string.

BACKGROUND OF THE INVENTION

Sport racquets, such as tennis, racquetball, squash and badminton racquets, are well known and typically include a head portion attached to a handle portion. The head portion forms a hoop supporting a latticework of tensioned strings. The latticework of strings is commonly referred to as a string bed and includes a plurality of intersecting cross and main string segments, which attach to the hoop portion. The handle portion typically includes a handle covered by a grip. Many racquets also include a throat portion positioned between and connecting the handle portion to the head portion.

There is a continuing desire to increase the responsiveness and performance of sport racquets, and, in particular, to increase the size of the central region of the string bed that provides the most responsiveness, the greatest power and the best "feel" to the player, upon impact with a ball. This central region of the string bed is commonly referred to as the "sweet spot." Incorporation of a larger sized hoop portion supporting a larger sized string bed (i.e., a larger head size) has been one approach used to increase the size of the string bed and the sweet spot. However, as the head size of a racquet increases so does the polar (or transverse) moment of inertia of the racquet. A racquet with a higher polar moment of inertia can be more difficult to maneuver, particularly at the net or upon return of serve, than a racquet with a lower moment of inertia. Additionally, some users find a large head racquets to be more difficult to swing than racquets with normal sized heads.

Other existing racquets attempt to increase the size of the sweet spot, or the responsiveness and power, of the racquet by increasing the length of four or more of the central most main strings. By increasing the length of only the central-most main strings, the responsiveness of the racquet can be increased without negatively affecting the control of the racquet. Many existing racquets incorporate a tear-drop shaped hoop portion forming a tear-drop shaped string bed wherein the central most main strings have a greater length than the remaining main strings. Although such racquets result in longer main strings than conventional racquets, the maximum main string length remains limited by the length of the head portion of the racquet, and the rules governing such length.

Another existing racquet design attempts to increase the responsiveness of the racquet through the use of a hollow handle having a first opening facing the hoop portion and a second opening at the butt end of the handle. The first opening and the hollow handle allow for two or more of the main strings to extend substantially along the entire length of the handle. A roller or pin is inserted at the butt end of the handle so that each main string extending through the handle wraps around the roller and extends back through the handle toward the hoop portion. Such racquets enable the length of two or more of the main strings to extend beyond the length of the hoop portion. However, the hollow handle construction with a first opening facing the hoop portion can be more expensive to produce than conventional racquet designs. The manufacture of such a racquet frame, particularly if formed of a composite material, can require the use of complex multi-piece molds. The use of such molds increases the complexity, and potentially to the cost of, manufacturing the racquet. Moreover, the handle of such racquets is exposed to the environment and therefore susceptible to contact with, and the potentially damaging effects of, moisture, dust and debris.

Thus, there is a continuing need for a racquet with improved responsiveness and an enlarged sweet spot that does not negatively affect the maneuverability of the racquet during use. What is needed is a racquet with improved responsiveness that can be efficiently and reliably produced. What is also needed is a racquet with increased responsiveness and a longitudinally enlarged sweet spot that fully complies with the length and size requirements of tennis, racquetball, squash and badminton organizations for organized play. Further, it would be advantageous to provide a racquet with improved responsiveness without exposing the interior of the handle to moisture, dust or debris. It would also be advantageous to provide a racquet with a means for reducing vibration transmitted upon impact with a ball from the elongated strings to the user.

SUMMARY OF THE INVENTION

The present invention provides a sports racquet extending along a longitudinal axis. The racquet includes a head portion and a handle portion. The head portion defines a string bed area. The handle portion has a distal end and a proximal end. The distal end of the handle portion is coupled to the head portion. The handle portion has a length and an outer surface. The handle portion includes at least two spaced apart channels. Each channel inwardly extends into the outer surface and extends generally parallel to the longitudinal axis from the distal end of the handle portion and over at least a portion of the length of the handle portion. Each channel is configured for receiving at least one string and for guiding the string along at least a portion of the length of the handle portion.

According to a principal aspect of the invention, a sports racquet includes a head portion and a handle portion. The handle portion has a distal end and a proximal end. The distal end of the handle portion is coupled to the head portion. The handle portion has a multi-sided transverse cross-sectional area, an outer surface and a length. First and second channels are defined into the handle portion. The first and second channels inwardly extend from the outer surface into opposite sides of the handle portion. Each channel extends over at least a portion of the length of the handle portion from the distal end toward the proximal end. Each channel is open and substantially uncovered by the handle portion. Each channel is configured for receiving at least one string.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
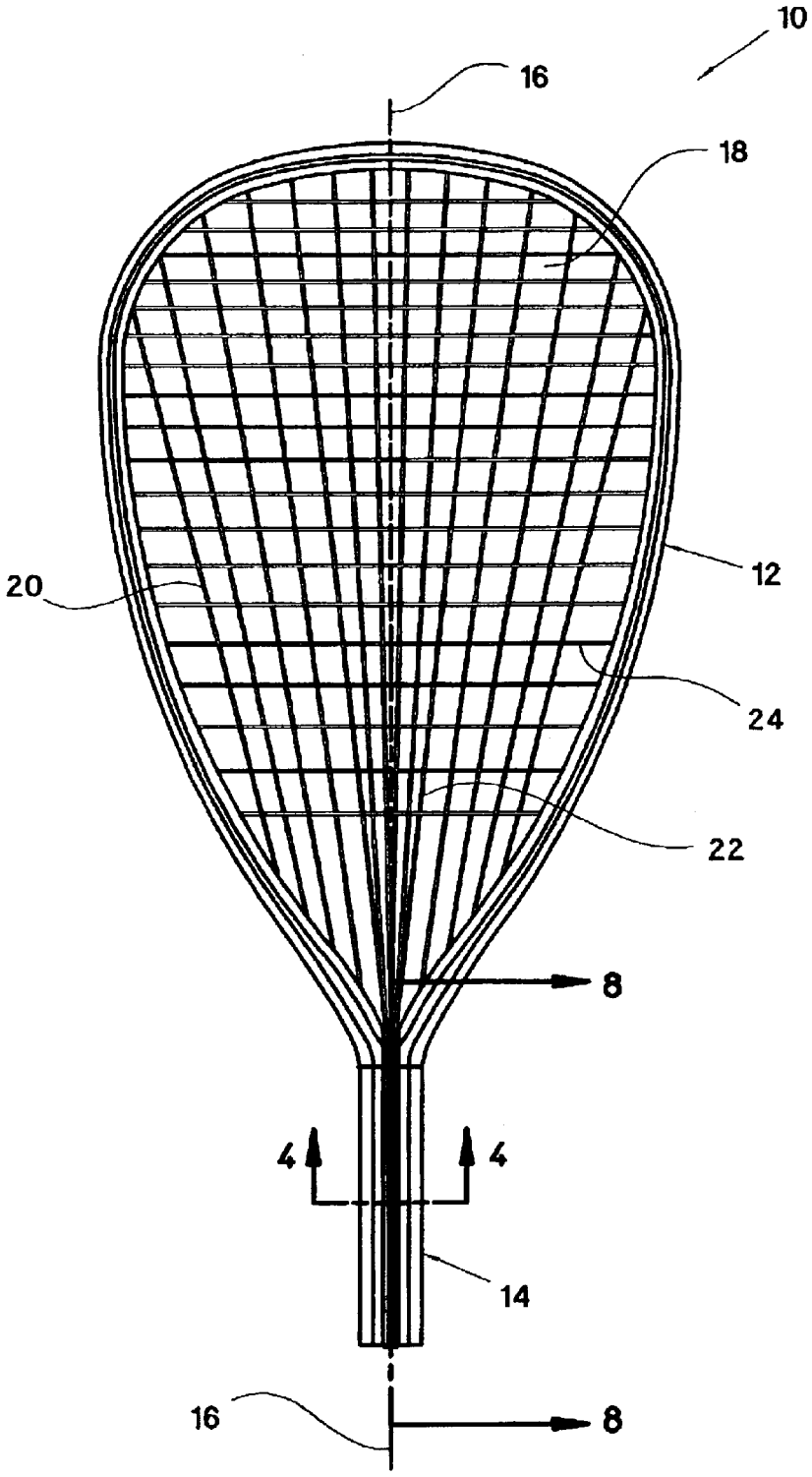
FIG. 1 is a front perspective view of a racquet shown without a butt cap or a grip in accordance with a preferred embodiment of the present invention.

Referring to FIG. 1, a sports racquet is indicated generally at 10. The racquet 10 of FIG. 1 is configured as a racquetball racquet, however, the invention can also be formed as other types of sports racquets, such as, for example, a tennis racquet, a squash racquet, or a badminton racquet. The racquet 10 includes a hoop portion 12 and a handle portion 14 outwardly extending from the hoop portion 12 along a longitudinal axis 16 of the racquet 10. The head portion 12 is a curved tubular structure preferably defining a generally tear drop shaped opening 18 for supporting a substantially planar latticework of strings in tension, also referred to as a string bed 20. In alternative preferred embodiments, the opening formed by the head portion 12 can be generally oval or generally circular. The head portion 12 is coupled to the handle portion 14. In one preferred embodiment, the head portion 12 is integrally formed with the handle portion 14. In another preferred embodiment, the head portion 12 is connected to the handle portion 14 using at least one fastener and/or an adhesive and combinations thereof. In yet another alternative preferred embodiment, the racquet 10 can include an elastomeric isolator (not shown) positioned between the head and handle portions 12 and 14.

The head portion 12 preferably includes a plurality of string holes (not shown) for receiving and supporting the string bed 20. The string bed 20 is formed by a plurality of main string segments 22 interwoven with a plurality of cross string segments 24. The main string segments 22 extend across the opening 18 in a direction generally parallel to the axis 16, and the cross string segment extend across the opening 18 in a direction generally perpendicular to the longitudinal axis 16.

Figure 2:
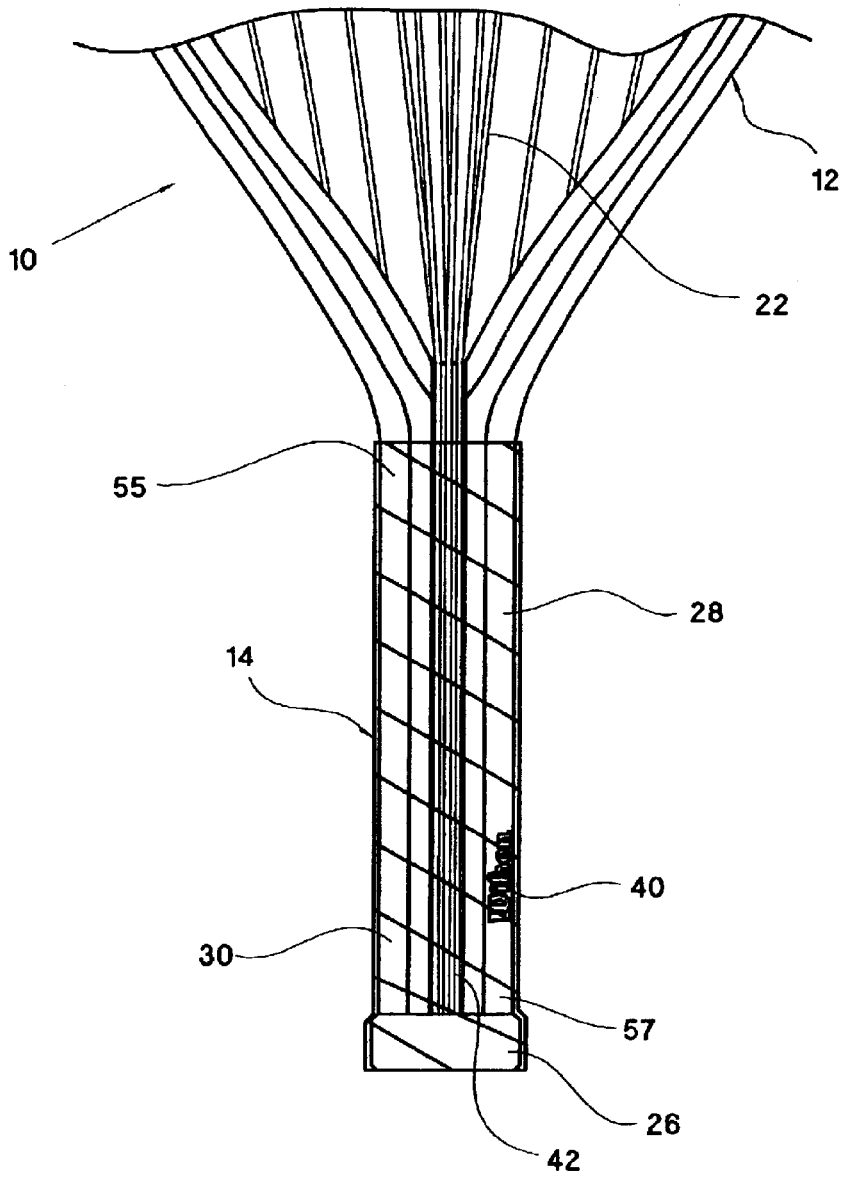
FIG. 2 is a front perspective view of a handle portion of the racquet of FIG. 1 including a butt cap and a generally transparent grip.

Referring to FIG. 2, the handle portion 14 includes a butt cap 26, and a grip 28, and a pallet 30. The butt cap 26 is a protective member, which generally covers a butt end 57 of the pallet 30. The butt cap 26 is formed of a lightweight, durable material, preferably a nylon. Alternatively, the butt cap 26 can be formed of other materials such as, PVC, PEBAX, thermoset materials and combinations thereof.

The grip 28 substantially covers the pallet 30 and at least a portion of the butt cap 26. The grip 28 is an elongate strip of soft, durable material, such as, for example, a polyurethane material. Alternatively, the grip 28 can be formed of other materials such as, for example, a leather, a synthetic leather, an elastomer, a rubber or other thermoset materials. The grip 28 is also preferably formed of a material that is translucent, transparent, semi-translucent or semi-transparent thereby making the pallet 30 visible through the grip 28. Alternatively, the grip 28 can also be non-transparent, non-translucent, single-colored, multi-colored, tinted or non-tinted. In one particularly preferred embodiment, the grip 28 can be formed in two separate portions: a first transparent or translucent portion, and a non-transparent or non-translucent portion. For example, one portion of the grip can be formed of a urethane foam and the second portion formed of a clear dense TPU. The grip 28 is typically spirally or helically wrapped about the outer surface of the pallet 30, or the intermediate layer (not shown). In an alternative preferred embodiment, the grip 28 can be a tubular sheath that is slidably connected to the outer surface of the pallet 30, or the intermediate layer. In a preferred embodiment, the grip 28 is affixed to the outer surface of the pallet 30, or an intermediate layer (not shown), using a suitable adhesive. Alternatively, the grip 28 can be attached to the pallet 30, or the intermediate layer, by other means, such as, for example, a conventional fluid adhesive, thermal bonding or mechanical bonding.

Figure 3:
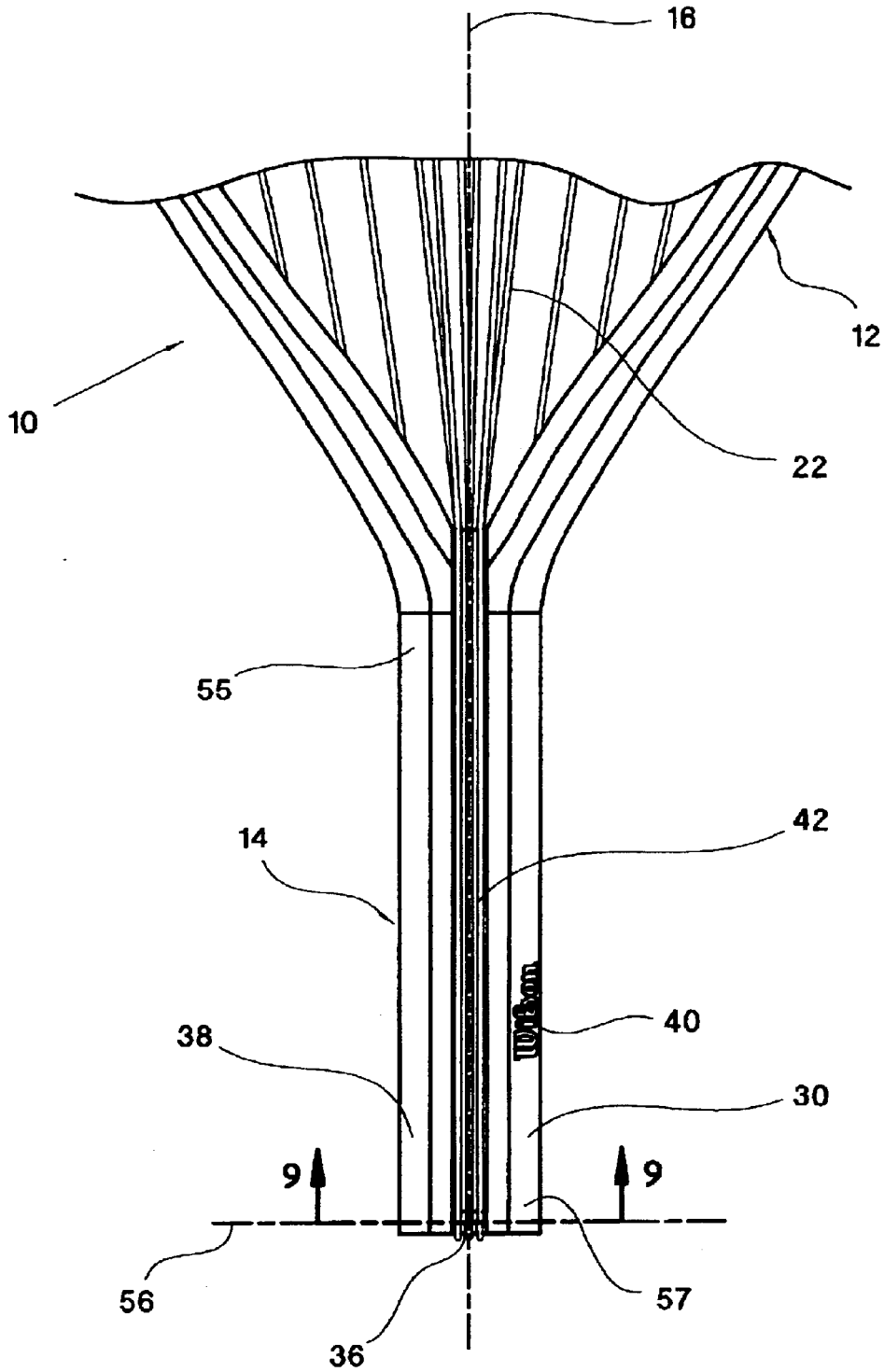
FIG. 3 is a front perspective view of a handle portion of the racquet of FIG. 1.
Figure 4:
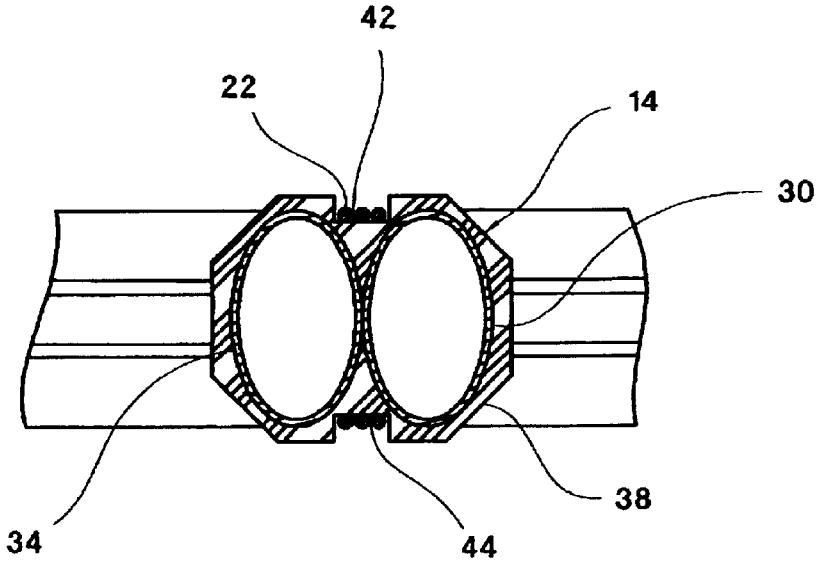
FIG. 4 is a transverse cross-sectional view of the handle portion of the racquet taken along line 4—4 of FIG. 1.

Referring to FIGS. 3 and 4, the handle portion 14 is shown in greater detail. The handle portion 14 further includes a handle 34, the pallet 30, and a bearing, such as a roller 36. The handle 34 is a rigid tubular structure preferably formed by a pair of tube ends extending down from the hoop portion 12. The tube ends are preferably extensions of the tubular structural member forming the hoop portion, which are coupled together to form the handle 34. The handle 34 can be formed of an alloy or a composite material. In a particularly preferred embodiment the handle is formed of an aluminum alloy. The pair of tube ends forming the handle 34 can be directly connected through conventional fasteners or adhesives.

The pallet 30 is formed about, and preferably substantially surrounds, the handle 34 to define a rigid gripping member. The pallet 30 has a hoop end 55 (or distal end) positioned opposite a butt end 57 (or proximal end). The pallet 30 preferably has an octagonal transverse cross-section formed by eight outer longitudinally extending surfaces interconnected along eight longitudinally extending gripping surfaces 38. In alternative preferred embodiments, the pallet 30 can have alternative transverse cross-sectional shapes such as, for example, other polygonal shapes, oval, circular and irregular. The pallet 30 is configured for grasping by one or both hands of a player during use. The pallet 30 is made of a strong, lightweight, durable material, preferably a structural urethane foam. Alternatively, the pallet 30 can be formed of other materials, such as, for example, other fiber composite materials, a graphite composite material, other structural foams, a plastic material, a metal or wood. In an alternative preferred embodiment, the pallet can be integrally molded into the handle to define a rigid gripping member.

Referring to FIGS. 2 and 3, the outer surface of the pallet 30, or an intermediate layer (not shown) placed over the pallet 30, can include indicia 40 representative of alphanumeric characters, graphics, specification information, advertising information, source data, trademarks, certification marks and combinations thereof. Specification information may include information such as installation instructions, dimensions, warnings, bar codes, test results and design features. Advertising information may include information such as slogans, product ratings, product attributes and information on related products. The indicia 40 may be single or multi-colored.

Figure 6:
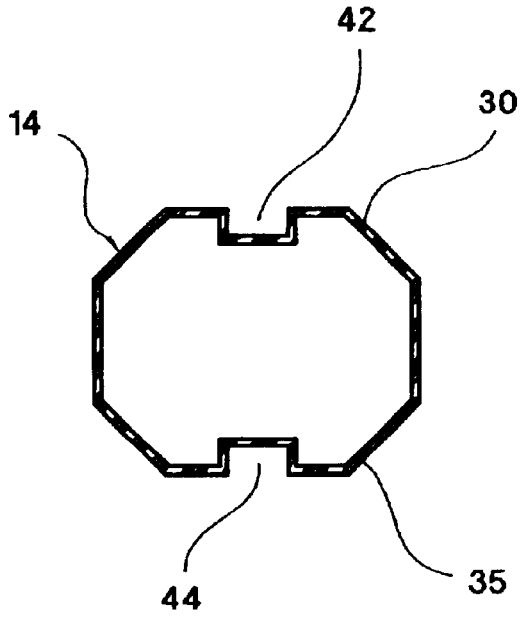
FIG. 6 is a transverse cross-sectional view of the handle portion of the racquet taken along line 6—6 of FIG. 5.
Figure 5:
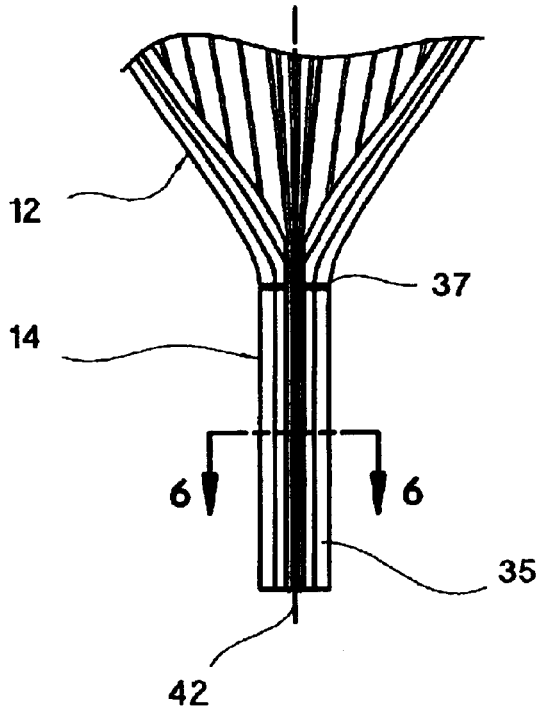
FIG. 5 is a front sectional view of a racquet in accordance with an alternative preferred embodiment of the present invention.

Referring to FIGS. 5 and 6, in an alternative preferred embodiment the handle portion 14 can include a handle 35 which is a tubular structural member formed separately from the tubes used to form the head portion 12. The handle 35 is integrally formed with the pallet 30, preferably as a one piece structure. In a particularly preferred embodiment the handle 35 is separated from the hoop portion 12 (and the potentially the throat portion) by a vibration dampening material, such as, for example, an elastomer 37. The vibration dampening material reduces the shock and/or vibration transmitted through the handle to the user.

Figure 9:
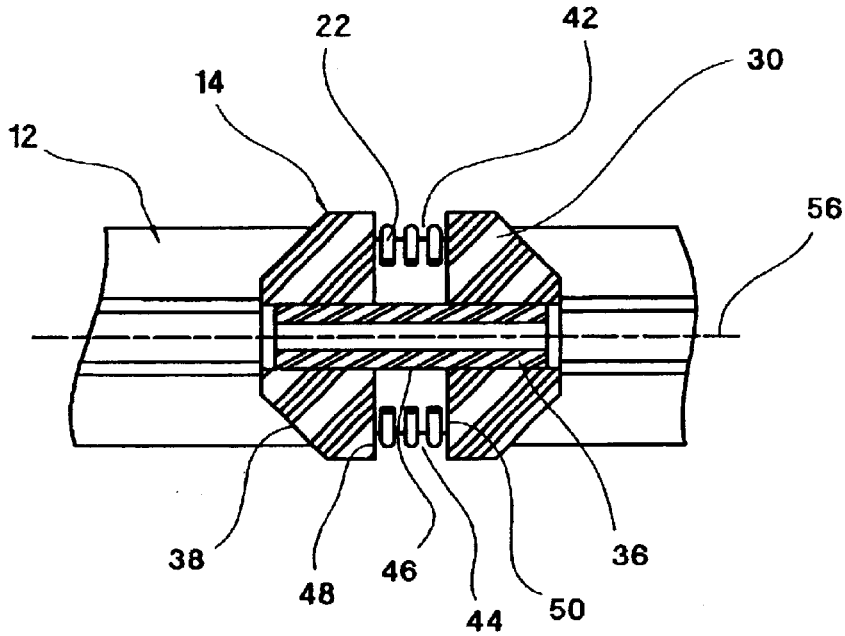
FIG. 9 is a transverse cross-sectional view of the handle portion of the racquet taken along line 9—9 of FIG. 3.
Figure 7:
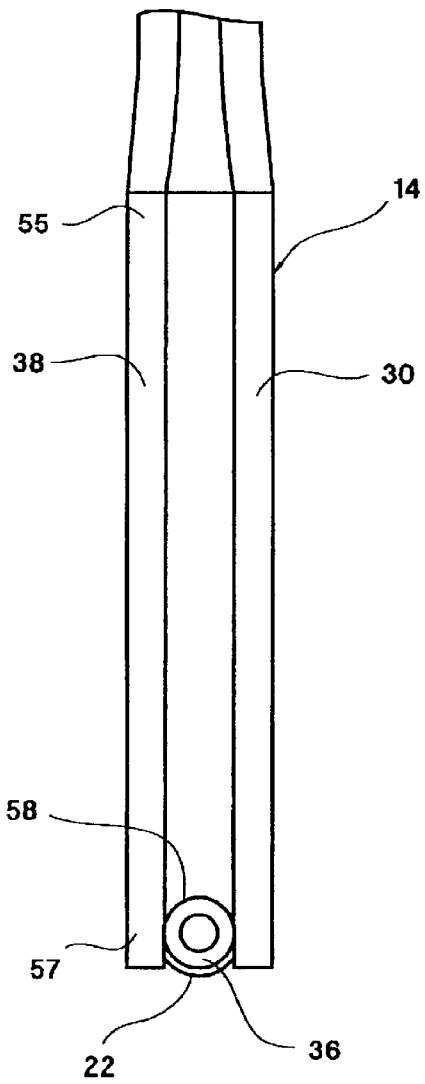
FIG. 7 is a side perspective view of a handle portion of the racquet of FIG. 1.
Figure 8:
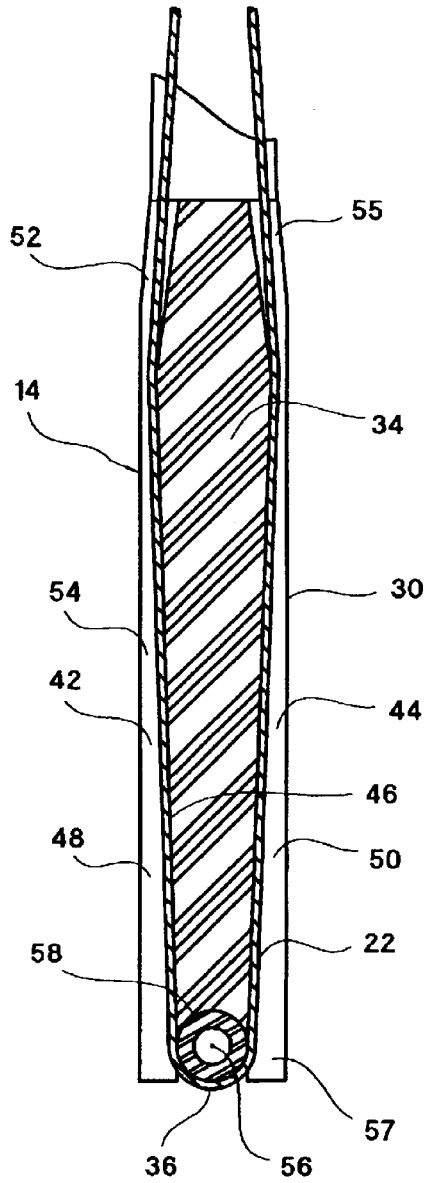
FIG. 8 is a longitudinal cross-sectional view of the handle portion of the racquet taken along line 8—8 of FIG. 1.

Referring to FIGS. 7–9, the handle portion 14 of the racquet 10 further includes first and second channels 42 and 44 inwardly extending into two of the gripping surfaces 38 on opposite sides of the pallet 30, and a bearing support element, such as a roller 36. Each of the first and second channels 42 and 44 extend generally parallel to the longitudinal axis 16 along at least a portion of the length of the handle portion 14. Preferably, the first and second channels 42 and 44 extend substantially the entire length of the handle portion 14 from the hoop end 55 toward the butt end 57 of the pallet 30. The first and second channels 42 and 44 provide a secure passageway for one or more of the main string segments 22 to extend beyond the hoop portion 12 and into the handle portion 14 of the racquet 10. The first and second channels 42 and 44 enable one or more of the main string segments 22 to be readily and efficiently strung down, and preferably fully wrapped around, the handle portion 14 without the main string segments 22 extending outside of the gripping surfaces 38 of the racquet 10. Accordingly, the first and second channels 42 and 44 provide a guide for the one or more main string segments 22 extending along the handle portion 14 without restricting or negatively affecting the installation of the grip 28. In one particularly preferred embodiment, three main string segments 22 extend down the first channel 42 around the proximal end of the handle portion and extend up the second channel 44. The first and second channels 42 and 44 are preferably formed of a depth sufficient to ensure that the one or main string segments 22 extending through the channels 42 and 44 remain separated or spaced apart from the grip 28, or other intermediate layer, placed over the pallet 30.

Figure 10:
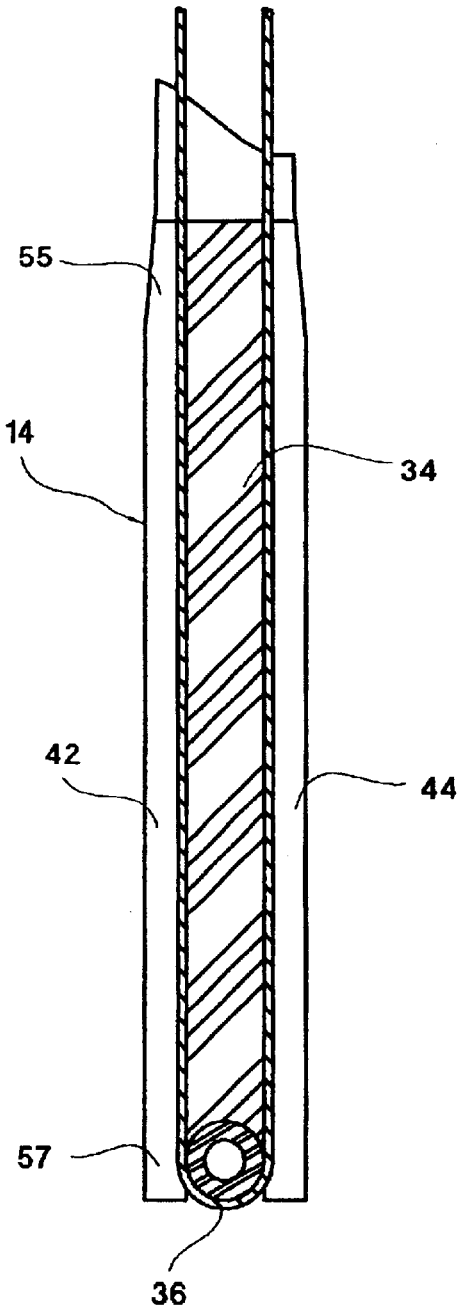
FIG. 10 is a longitudinal cross-sectional view of a handle portion of a racquet in accordance with an alternative preferred embodiment of the present invention.

Referring to FIGS. 8 and 9, in a preferred embodiment, the first and second channels 42 and 44 preferably have a generally U-shaped transverse cross sectional area. Each channel 42 and 44 is formed by a bottom channel wall 46 and two channel side walls 48 and 50. The depth of each channel 42 and 44 preferably varies, with respect to the outer surface of the pallet 30, over the length of the handle portion 14. In a particularly preferred embodiment, each channel 42 and 44 includes at least first and second regions 52 and 54. The first region 52 having a first predetermined depth at the hoop end 55 which decreases as the channel extends from the hoop end 55 along the handle portion 14 in a direction toward the butt end 57 of the pallet 30. The second region 54 is positioned adjacent to the first region 52. The depth of the second region 54 increases as the channel extends from the hoop end 55 along the handle portion 14 in a direction toward the butt end 57 of the pallet 30. In alternative preferred embodiments, each channel 42 and 44 can include one or more regions, wherein the regions can have a variable depth along its length, a generally constant depth along its length, or combinations thereof. For example, referring to FIG. 10, in one alternative preferred embodiment, the entire length of each channel 42 and 44 can have a generally consistent, uniform depth. The varying depth of the region over the length of the handle portion 14 can be linear or non-linear resulting in uniformly sloped or curved bottom channel walls with respect to the handle portion 14.

Referring to FIGS. 8 and 9, the roller 36 is a generally cylindrical member having a roller axis 56 that is positioned generally perpendicular to the axis 16 of the racquet 10. The roller 36 is preferably positioned adjacent to the proximal end of the first and second channels 42 and 44 in a generally cylindrical groove 58 formed in the butt end 57 of the handle portion 14. The groove 58 is advantageously positioned such that, when the roller 36 is installed, at least a portion of the curved portion of the roller 36 is aligned with the proximal ends of the first and second channels 42 and 44. This roller position provides a path for the at least one main string segment 22 to extend from the hoop portion 16 toward the butt end 57 of the handle portion 14 through the first channel 40, wrap around at least a portion of the curved surface of the roller 36 and then extend through the second channel 42 to the hoop portion 16 of the racquet 10. The roller 36 is preferably press-fit into the groove 58 of the handle portion 14. In alternative preferred embodiments, the roller 36 can be attached to the handle portion 14 through the use of a pin, an adhesive, other conventional fasteners or combinations thereof. The roller 36 is preferably fixedly secured to the handle portion 14. In an alternative preferred embodiment, the roller 36 can be attached to the handle portion 14 in a manner that allows for rotation of the roller 36 with respect to the handle portion 14.

Figure 11:
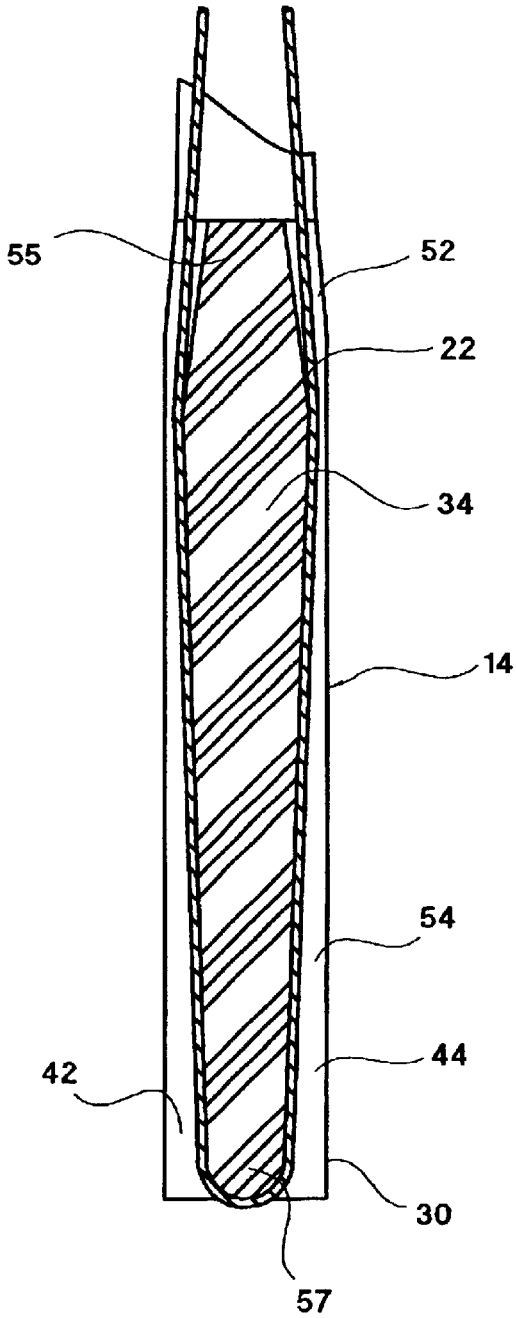
FIG. 11 is a longitudinal cross-sectional view of a handle portion of a racquet in accordance with another alternative preferred embodiment of the present invention.

The roller 36 is made of a durable, wear resistant material, preferably, a nylon. Alternatively, the roller 36 can be formed of other materials, such as, for example, a urethane, a polyamide, a rubber, wood, other polymeric materials and combinations thereof. The roller 36 provides a bearing surface for the main string segment 22 which inhibits string wear and protects the string segment from contact with sharp edges and rough surfaces. The roller 36 also provides a minimum bend radius thereby reducing the bending stresses applied to the one or more main string segments 22 which may extend from the first channel 40 to the second channel 42. In alternative preferred embodiments, the roller 36 can be replaced with other forms of bearings, such as, for example, a rod, a pin, a wear resistant coating formed over at least a portion of the butt, or proximal, end of the handle portion 14, a semi-cylindrical member, a curved plate, a generally flat plate and combinations thereof. Referring to FIG. 11, in another alternative preferred embodiment, the handle portion 14 of the racquet 10 can be formed without a roller 36 or other separate bearing element.

Figure 12:
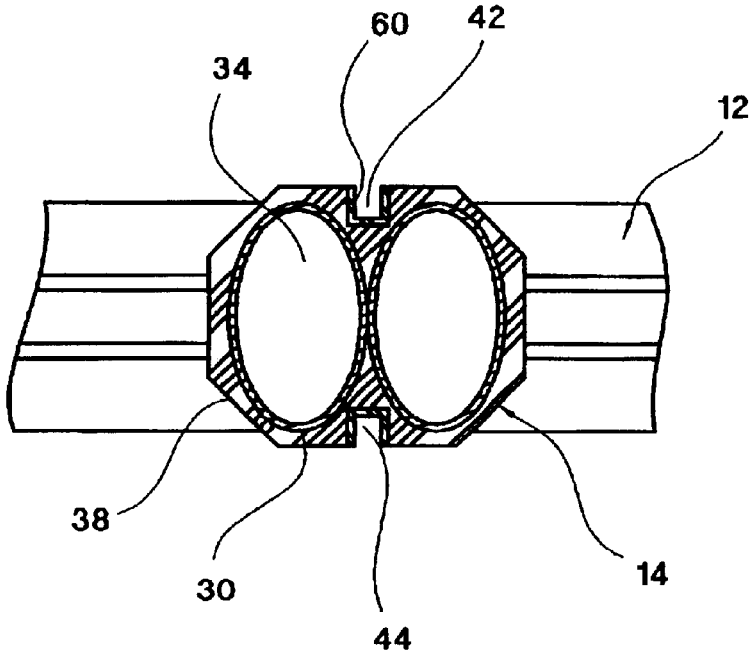
FIGS. 12–16 are transverse cross-sectional views of a handle portion of racquets in accordance with five additional alternative preferred embodiments of the present invention.

Referring to FIG. 12, in an alternative preferred embodiment, a protective wear resistant layer 60 can be applied over the surfaces forming the first and second channels 42 and 44. The protective layer 60 is fixedly attached to the channels 42 and 44 preferably, with an adhesive. Alternatively, the protective layer 60 can be attached to the channels 42 and 44 through other means, such as, for example, press-fit, interference fit, thermal bonding, chemical bonding, snap-fit fasteners, or other conventional fastening means. The protective layer 60 is made of a durable, wear resistant material, preferably, an elastomer. Alternatively, the protective layer 60 can be formed of other materials, such as, for example, a urethane, a nylon a polyamide, a rubber, wood, other polymeric materials and combinations thereof. The protective layer 60 inhibits wear of the at least one main string segment 22. In one particularly preferred embodiment, the resistant layer 60 extends substantially along the entire channel. In an alternative preferred embodiment, the layer 60 can extend partially along the channel, or can be two or more pieces spaced apart along the channel.

Figure 13:
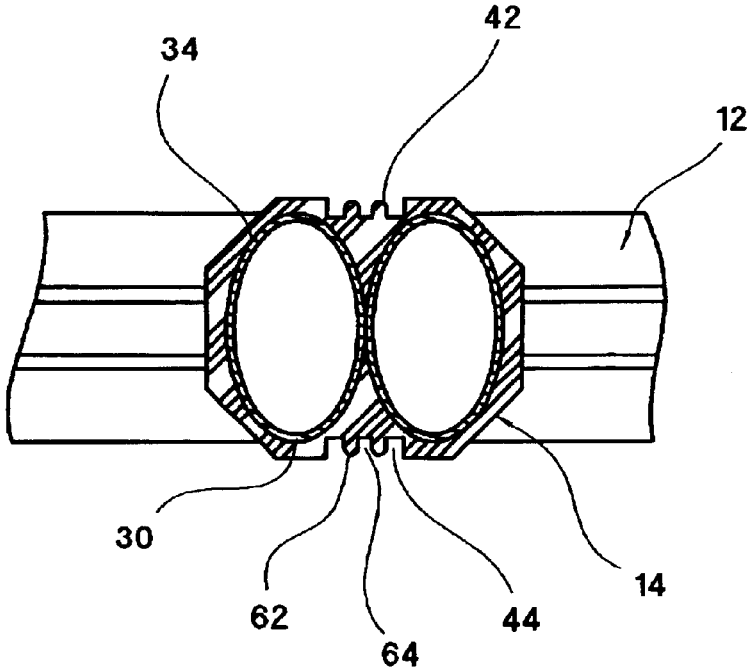

Referring to FIG. 13, in another alternative preferred embodiment, the handle portion 14 can further include at least one rib 62 outwardly extending into each of the first and second channels 42 and 44. The at least one rib 62 outwardly extends from the bottom channel wall 46 of each of the first and second channels 42 and 44 and longitudinally extending along at least a portion of the channels 42 and 44. The at least one rib 62 forms a plurality of sub-channels 64 within the channels 42 and 44. Each sub-channel 62 is configured to receive one or more main string segment 22 and to space apart multiple main string segments 22 extending through the channels 42 and 44.

Figure 14:
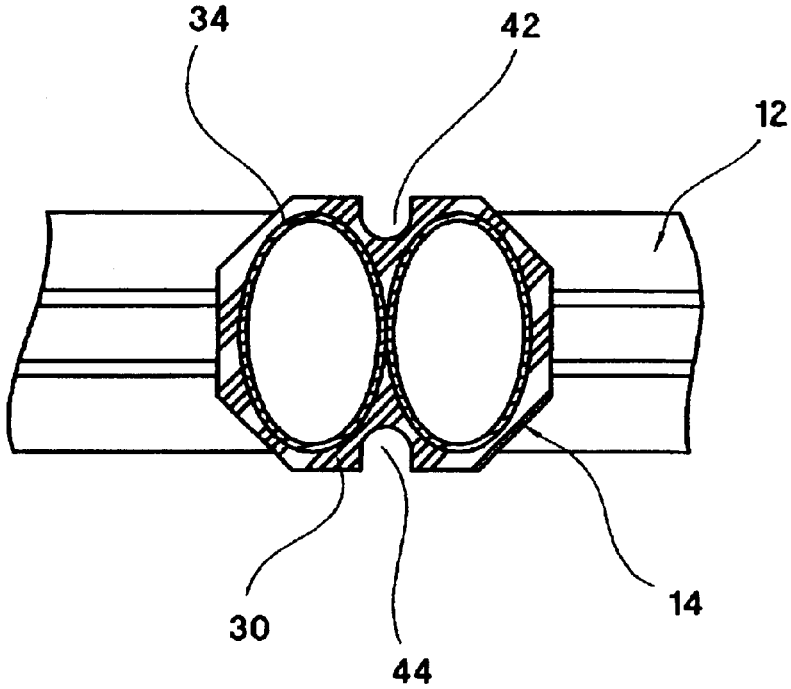
Figure 15:
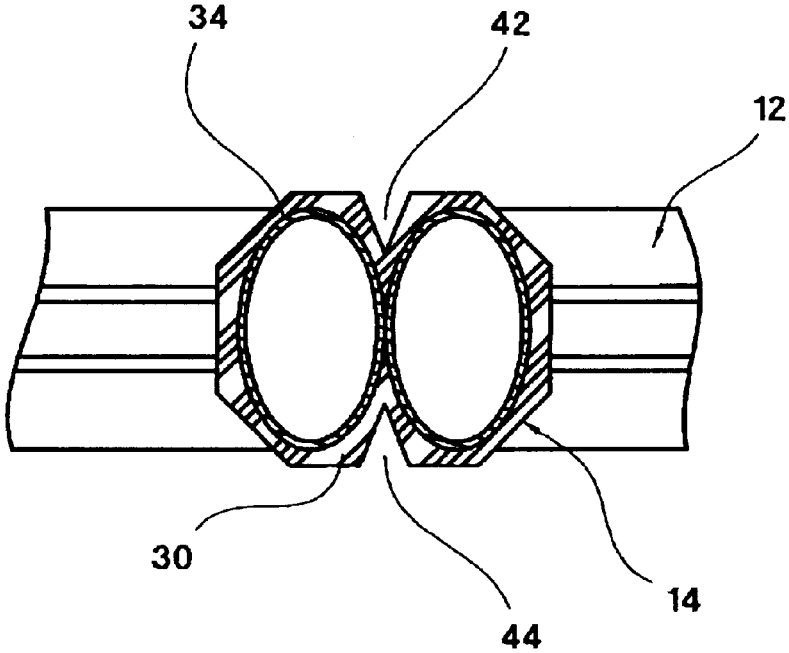

Referring to FIGS. 14 and 15, in alternative preferred embodiments, the first and second channels 42 and 44 can be formed with alternative transverse cross-sectional shapes. For example, the first and second channels 42 and 44 can be formed with a transverse cross-sectional shape having a U-shape (FIG. 11) or a V-shape (FIG. 12). In other alternative preferred embodiments the transverse cross-sectional shape of the first and second channels can be semi-circular, generally polygonal, or irregular.

Figure 16:
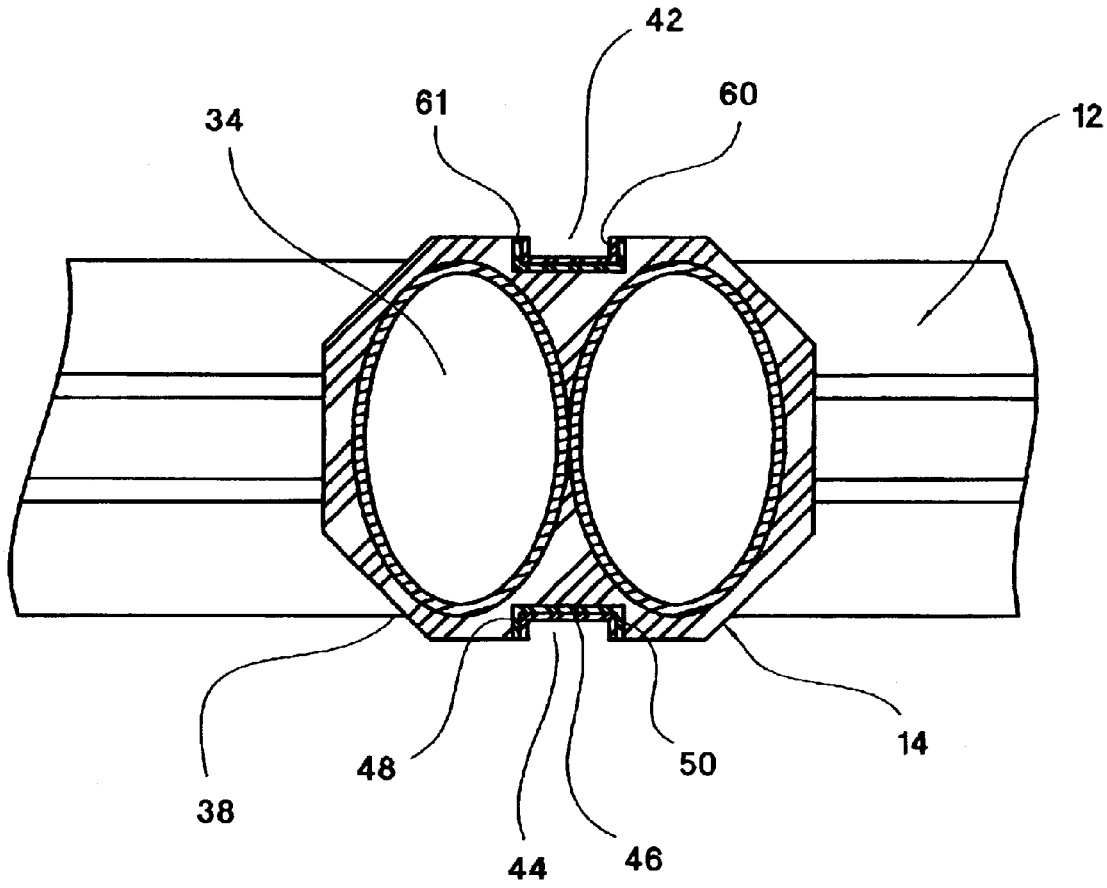

Referring to FIG. 16, in another alternative preferred embodiment, a vibration absorbing layer 61 and the protective layer 60 can be inserted within the first and second channels 42 and 44. The vibration-absorbing layer 61 is formed of a resilient, relatively soft material, preferably a synthetic rubber. Alternatively, the vibration-absorbing layer 61 can be formed of other materials such as for example, a natural rubber, a urethane, an elastic polymeric material or combinations thereof. The material of the vibration-absorbing layer 61 has good shock and vibration dampening properties and, preferably, has a durometer of less than 90 on the Shore A hardness scale.

The vibration-absorbing layer 61 is placed within at least one of the first and second channels 42 and 44, and extends over at least part of at least one of the bottom channel wall 46, the two channel side walls 48 and 50. Preferably, the vibration-absorbing layer extends over at least a portion of the bottom and the two side walls 46, 48 and 50. In a particularly preferred embodiment, the vibration-absorbing material 61 substantially covers the bottom and side walls 46, 48 and 50. The vibration-absorbing layer 61 can be attached to the first and second channels 42 and 44, through use of an adhesive or through other conventional attachment means. The protective layer 60 is positioned within the first and second channels 42 and 44 over, and preferably substantially covering, the vibration-absorbing layer 61. The protective layer 60 can be positioned with the use of an adhesive or other conventional attachment means, such as, for example, interference fit, press-fit, and thermal bonding. In another embodiment, the layers 60 and 61 can be held in place at least by the main string segments extending along the channel. The material of the protective layer 60 preferably has a durometer which is greater than the durometer of the vibration-absorbing material 61.

Figure 17:
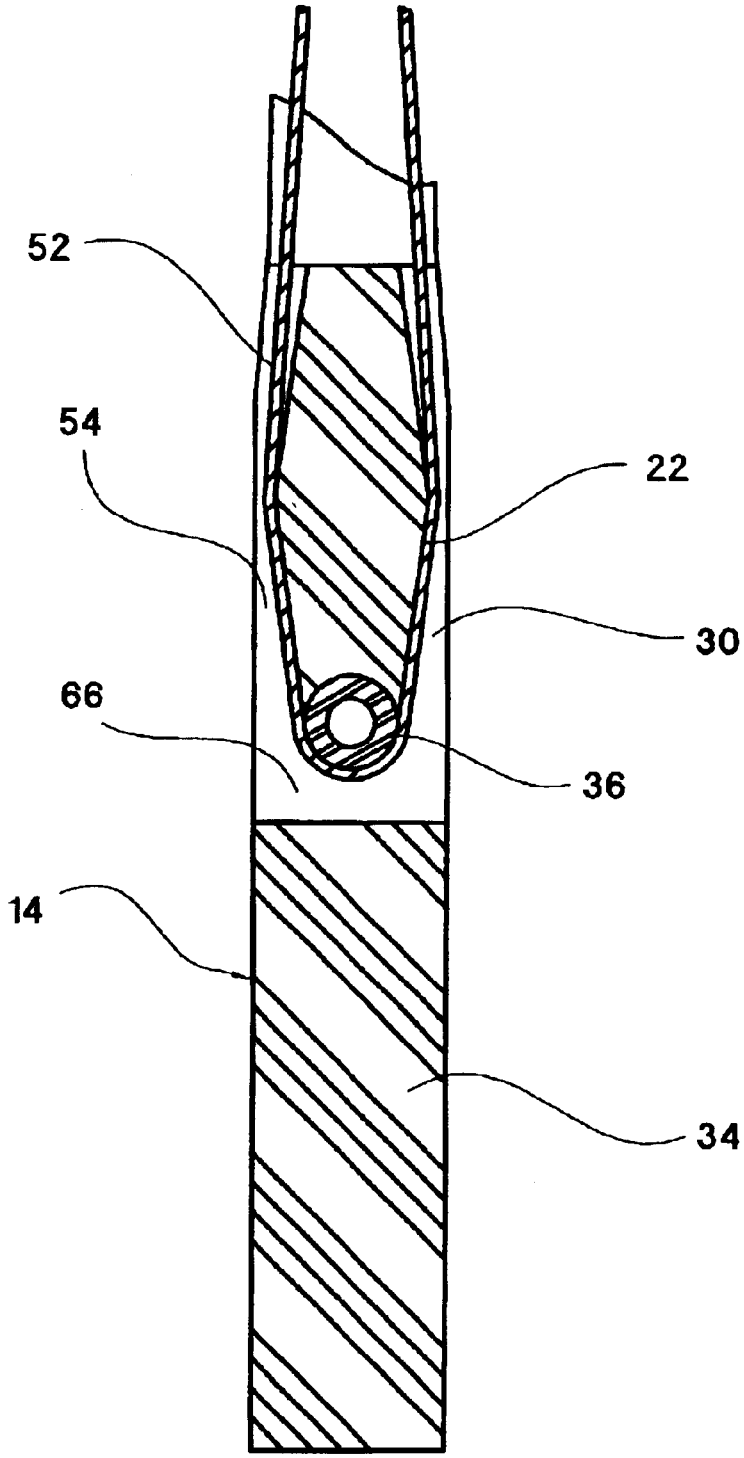
FIG. 17 is a longitudinal cross-sectional view of a handle portion of a racquet in accordance with another alternative preferred embodiment of the present invention.

Referring to FIG. 17, in another alternative preferred embodiment, the first and second channels 42 and 44 do not longitudinally extend along the entire length of the handle portion 14, and a string passage 66 is formed through the handle portion 14. The string passage 66 is preferably positioned adjacent to the proximal ends of the first and second channels 42 and 44, and the roller 36 is preferably positioned in the handle portion 14 so as to partially extend into the passage 66. The passage 66 enables the main string segments to extend from the first channel 40 to the second channel 42. The length of the channels 42 and 44 and the corresponding location of the passage 66 can be positioned at any location along the length of the handle portion 14 thereby allowing for the effective length of the main string segments 22 passing through the channels 42 and 44 and the passageway to be optimized to meet the desired racquet string bed response.

Figure 18:
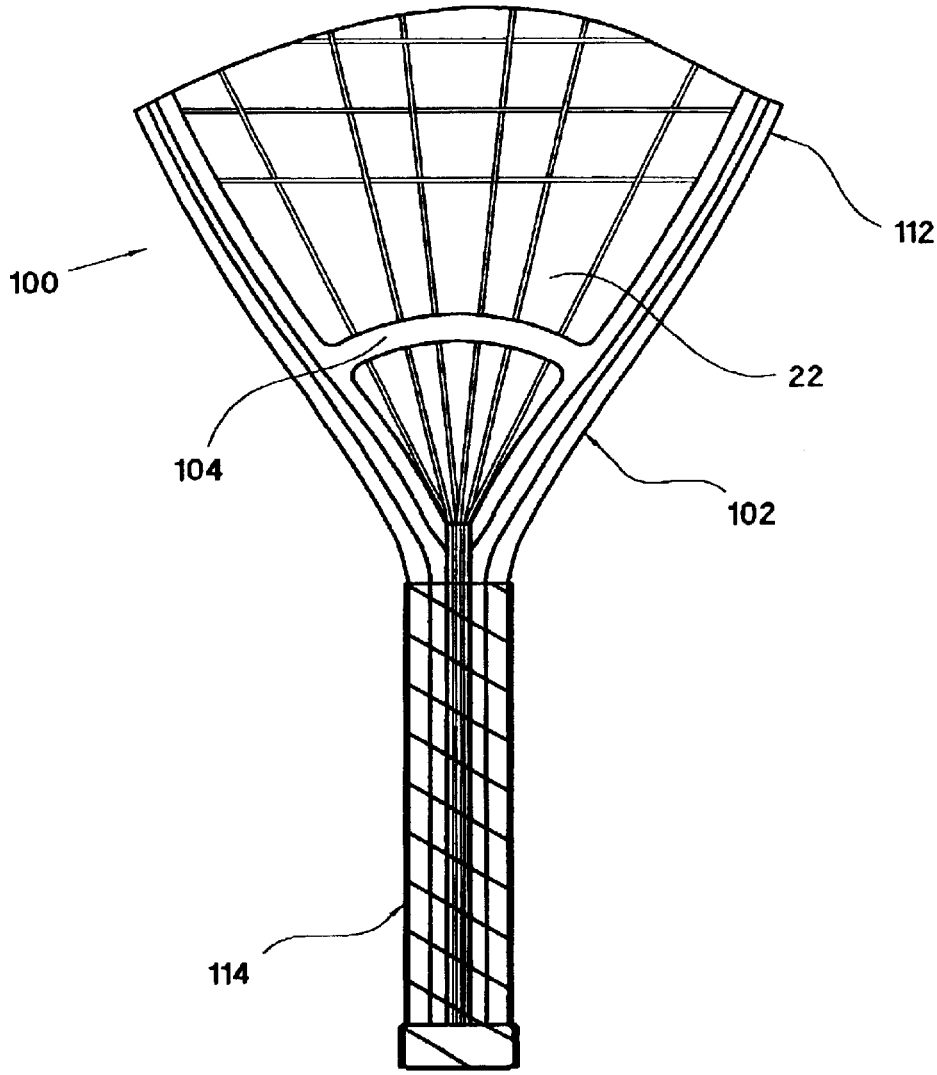
FIG. 18 is a front perspective view of a lower portion of a tennis racquet in accordance with a preferred embodiment of the present invention.

Referring to FIG. 18, one preferred embodiment of the present invention applied to a tennis racquet 100 is illustrated. The tennis racquet 100 includes a throat portion 102 positioned between the hoop and handle portions 112 and 114. The throat portion 102 preferably includes a yoke 104. The yoke 104 includes a plurality of string holes for routing the main string segments 22 from the hoop portion 112 to the throat portions 102. The yoke 104 also preferably forms a portion of the hoop portion 112 defining the string bed. The main string segments 22 then fully extend through the throat portion 102 and into the handle portion 114 of the racquet 100. The handle portion 114 is substantially similar to the handle portion 14 described above. In alternative preferred embodiments, the tennis racquet 100 can include an alternate yoke design, or more than one yoke. Alternatively, the tennis racquet 100 can be formed without a yoke. The main string segments 22 are shown in a "fanned" configuration. In an alternative preferred embodiment, the main string segments 22 can be positioned to extend substantially parallel to the longitudinal axis 16 as they extend across the string bed area 18, or in a combination of parallel and fanned.

The present invention provides for a racquet with improved responsiveness and a longitudinally enlarged sweet spot without negatively affecting the maneuverability of the racquet. The present invention increases the length of the centrally positioned main strings thereby increasing the power and responsiveness of the racquet when a ball impacts the elongated main strings, without significantly increasing the moment of inertia of the racquet. The present invention can be readily produced without significantly increasing the complexity or cost of the racquet. The present invention further provides a racquet with extended main string segments for improved racquet performance without exposing the extended main string segments to moisture, dirt or debris. The present invention further provides a racquet that can be readily strung. When the protective and dampening layers of the present invention are also used, the present invention provides the benefits of lengthened main strings while reducing the shock and vibration transferred to the user's hand during use.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A sports racquet extending along a longitudinal axis, the racquet comprising:

a head portion defining a string bed area;

a handle portion having a distal end and a proximal end, the distal end of the handle portion coupled to the head portion, the handle portion having a length and an outer surface, the handle portion including at least two spaced apart channels, each channel inwardly extending into the outer surface and extending generally parallel to the longitudinal axis from the distal end of the handle portion and over at least a portion of the length of the handle portion;

a string bed engaged to the head portion, the string bed formed of a plurality of cross string segments and a plurality of main string segments, at least one of the main string segments extending along at least one of the channels; and a grip disposed over the handle portion, the channels, and at least a portion of the at least one main string segment, and wherein at least a portion of the grip is formed of a material selected from the group consisting of a transparent material, a translucent material, a semi-transparent material, semi-translucent material, and combinations thereof.

2. The racquet of claim 1 wherein the at least two spaced apart channels include at least four spaced apart channels.

3. The racquet of claim 1 wherein the depth of each channel with respect to the outer surface of the handle portion varies over the length of the handle portion.

4. The racquet of claim 3, wherein each channel includes at least first and second portions, and wherein the first portion decreases in depth with reference to the outer surface of the handle portion as the first portion extends from the distal end toward the proximal end of the handle portion.

5. The racquet of claim 4, wherein the second portion of the channel increases in depth as the second portion extends toward the proximal end of the handle portion.

6. The racquet of claim 4 wherein the first and second portions of each channel are sloped or curved with respect to the longitudinal axis.

7. The racquet of claim 4 wherein each of the first and second portions of the channel extend over at least 10 percent of the length of the channel.

8. The racquet of claim 1 further including a protective layer disposed over the channel.

9. The racquet of claim 8, further comprising a vibration-absorbing layer positioned between the protective layer and the channel, wherein the vibration-absorbing layer generally covers the channel, and wherein the protective layer generally covers the vibration-absorbing layer.

10. A sports racquet extending along a longitudinal axis, the racquet comprising:

a head portion defining a string bed area;

a handle portion having a distal end and a proximal end, the distal end of the handle portion coupled to the head portion, the handle portion having a length and an outer surface, the handle portion including at least two spaced apart channels, each channel inwardly extending into the outer surface and extending generally parallel to the longitudinal axis from the distal end of the handle portion and over at least a portion of the length of the handle portion, each channel configured for receiving at least one string and guiding the string along at least a portion of the length of the handle portion; and at least one rib outwardly extending from the handle portion into each of the first and second channels forming a plurality of sub-channels within each of the first and second channels.

11. A sports racquet comprising:

a head portion;

a handle portion having a distal end and a proximal end, the distal end of the handle portion coupled to the head portion, the handle portion having a multi-sided transverse cross-sectional area, an outer surface and a length; and first and second channels defined into the handle portion, the first and second channels inwardly extending from the outer surface into opposite sides of the handle portion, each channel extending over at least a portion of the length of the handle portion from the distal end toward the proximal end, each channel being open and substantially uncovered by the handle portion, each channel configured for receiving at least one string; and a bearing attached to the proximal end of the racquet, the bearing further guiding the at least one string around the proximal end of the handle portion.

12. The racquet of claim 11, wherein the bearing is selected from the group consisting of a rod, a roller, a semi-cylindrical member, a wear-resistant coating, a curved plate and a flat plate.

13. The racquet of claim 11 further including a protective layer disposed over the channel.

14. The racquet of claim 13, further comprising a vibration-absorbing layer positioned between the protective layer and the channel, wherein the vibration-absorbing layer generally covers the channel, and wherein the protective layer generally covers the vibration-absorbing layer.

15. The racquet of claim 11 wherein the multi-sided handle portion has between two and twelve side.

16. The racquet of claim 11 wherein the depth of each channel with respect to the outer surface of the handle portion varies over the length of the handle portion.

17. The racquet of claim 11 wherein each channel has a transverse cross-sectional shape selected from the group consisting of: a U-shape, a V-shape, a semi-circle, a polygonal shape, a grooved shape, an irregular shape, and combinations thereof.

18. The racquet of claim 11 wherein the depth of each channel with respect to the outer surface of the handle portion varies over the length of the handle portion.

19. A sports racquet comprising:

a head portion;

a handle portion having a distal end and a proximal end, the distal end of the handle portion coupled to the head portion, the handle portion having a multi-sided transverse cross-sectional area, an outer surface and a length;

first and second channels defined into the handle portion, the first and second channels inwardly extending from the outer surface into opposite sides of the handle portion, each channel extending over at least a portion of the length of the handle portion from the distal end toward the proximal end, each channel being open and substantially uncovered by the handle portion;

a string bed engaged to the head portion, the string bed formed of a plurality of cross string segments and a plurality of main string segments, at least one of the main string segments extending along at least one of the channels; and a grip disposed over the handle portion, the channels, and at least a portion of the at least one main string segment, and wherein at least a portion of the grip is formed of a material selected from the group consisting of a transparent material, a translucent material, a semi-transparent material, semi-translucent material, and combinations thereof.

20. The racquet of claim 19 wherein the handle portion further includes a through handle hole, and wherein the at least one string extends along one of the spaced apart channels, through the hole and along the other of the spaced apart channels.

21. The racquet of claim 20 wherein a bearing is positioned adjacent to the hole to further guide the at least one string.

22. The racquet of claim 21, wherein the bearing is selected from the group consisting of a rod, a roller, a tube, a cylinder, a grooved member and a plate.

23. The racquet of claim 19 wherein each channel has a transverse cross-sectional shape selected from the group consisting of: a U-shape, a V-shape, a semi-circle, a polygonal shape, a grooved shape, an irregular shape, and combinations thereof.

24. A sports racquet comprising:

a head portion;

a handle portion having a distal end and a proximal end, the distal end of the handle portion coupled to the head portion, the handle portion having a multi-sided transverse cross-sectional area, an outer surface and a length;

first and second channels defined into the handle portion, the first and second channels inwardly extending from the outer surface into opposite sides of the handle portion, each channel extending over at least a portion of the length of the handle portion from the distal end toward the proximal end, each channel being open and substantially uncovered by the handle portion, wherein the depth of each channel with respect to the outer surface of the handle portion varies over the length of the handle portion; and a string bed engaged to the head portion, the string bed formed of a plurality of cross string segments and a plurality of main string segments, at least one of the main string segments extending along at least one of the channels.

25. The racquet of claim 24, wherein each channel includes at least first and second portions, and wherein the first portion decreases in depth with reference to the outer surface of the handle portion as the first portion extends from the distal end toward the proximal end of the handle portion.

26. The racquet of claim 25, wherein the second portion of the channel increases in depth as the second portion extends toward the proximal end of the handle portion.

27. The racquet of claim 25 wherein the first and second portions of each channel are sloped or curved with respect to the outer surface of the handle portion.

28. The racquet of claim 25 wherein each of the first and second portions of the channel extend over at least 10 percent of the length of the channel.

* * * * *